US007516908B1

(12) United States Patent
Sack

(10) Patent No.: US 7,516,908 B1
(45) Date of Patent: Apr. 14, 2009

(54) FIRE RETARDANT DISCHARGE APPARATUS

(76) Inventor: George E. Sack, 12059 Davenport Rd., Aqua Dulce, CA (US) 91390

( * ) Notice: Subject to any disclaimer, the term of this patent is extended or adjusted under 35 U.S.C. 154(b) by 162 days.

(21) Appl. No.: 11/788,720

(22) Filed: Apr. 19, 2007

(51) Int. Cl.
*B05B 1/34* (2006.01)

(52) U.S. Cl. ..... 239/383; 239/143; 239/164; 239/169; 239/172; 239/381; 239/525; 239/589; 239/590.5; 239/600; 239/654; 169/24; 169/70; 169/77; 406/39; 406/136; 406/154

(58) Field of Classification Search ..... 239/142, 239/143, 159, 160, 164, 169, 172, 175, 214, 239/214.13, 215, 373, 380–383, 432, 499, 239/502, 505, 525, 589, 590, 590.5, 600, 239/654; 169/14, 15, 24, 52, 70, 77, 85; 406/39, 136, 141, 142, 154, 162; 241/38, 241/39, 91
See application file for complete search history.

(56) References Cited

U.S. PATENT DOCUMENTS 2,562,930 A * 8/1951 Mapes ..... 169/77
4,515,311 A * 5/1985 Takata ..... 239/172
4,553,698 A * 11/1985 Parker et al. ..... 239/654
5,050,995 A * 9/1991 Lucore, II ..... 239/142
5,242,023 A * 9/1993 Terry et al. ..... 169/70
6,098,904 A * 8/2000 Davidson et al. ..... 239/590
6,889,773 B2 * 5/2005 Hanratty ..... 239/590

* cited by examiner

*Primary Examiner*—Steven J Ganey
(74) *Attorney, Agent, or Firm*—Dennis W. Beech

(57) ABSTRACT

The present invention may be used for discharging a fire retardant material. A container element may be connected to a pressurized gas source controllable to pressurize the container element and to flow a gas and fire retardant material mixture through a discharge conduit. A discharge device may be connected at an inlet to the discharge conduit. The discharge device may have an inlet duct attached to an inlet end of an expansion section. The expansion section may be connected to an inlet end of an outlet duct having an outlet nozzle. A diffuser may be disposed in the inlet duct and an upstream portion and may be attached in the upstream portion. The diffuser may have a nose element attached by a diffuser shaft to a base element with a rotor element having multiple vanes rotatably attached to the diffuser shaft intermediate the nose and base elements.

12 Claims, 3 Drawing Sheets

FIRE RETARDANT DISCHARGE APPARATUS

BACKGROUND OF THE INVENTION

This invention relates to apparatus for retarding or suppressing fires. The new fire retardant discharge apparatus may have a retardant and air container and mixer connected to a discharge device for dispensing retardant through the air to be deposited on a fire.

Transport of fire retardant materials to fight large fires, such as forest fires, may usually is done with the use of aircraft that may be fixed wing aircraft or helicopters. The fire retardant that may be di-ammonium phosphate, PHOS CHEK or other generally solid retardants may be dropped from the air at a fire location with a widely varying degree of effectiveness. The fire retardant drop may be affected by weather conditions as well as pilot capabilities.

Water or other fluid retardants may also be transported and dropped by aircraft. The traditional fire engine may be used to pump water to be sprayed on a fire using a hose. Water may be a relatively heavy, bulky product to carry as compared to generally dry powder type fire retardant materials.

SUMMARY OF THE INVENTION

The present invention is directed to apparatus for discharging a fire retardant material. A container element may be connected to a pressurized gas source controllable to pressurize the container element and to flow a gas and fire retardant material mixture through a discharge conduit. A discharge device may be connected at an inlet to the discharge conduit. The discharge device may have an inlet duct attached to an inlet end of an expansion section. The expansion section may be connected to an inlet end of an outlet duct having an outlet nozzle.

A diffuser may be disposed in the inlet duct and an upstream portion and may be attached in the upstream portion. The diffuser may have a nose element attached by a diffuser shaft to a base element with a rotor element rotatably attached to the diffuser shaft intermediate the nose and base elements. The rotor element may have multiple vanes attached to an outer surface inclined relative to a longitudinal axis of the discharge device.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
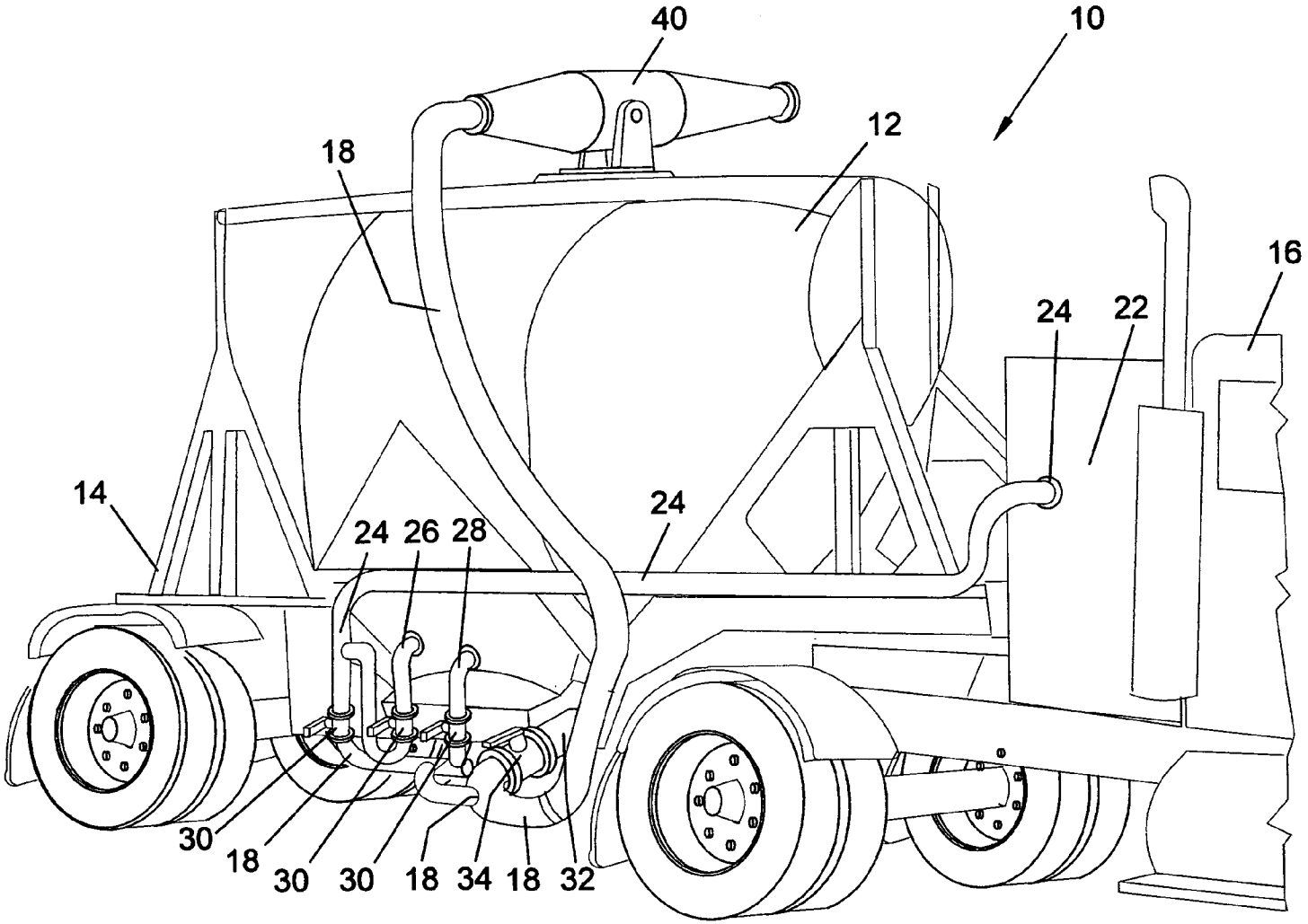
FIG. 1 illustrates a perspective view of a fire retardant discharge apparatus according to an embodiment of the invention.
Figure 3:
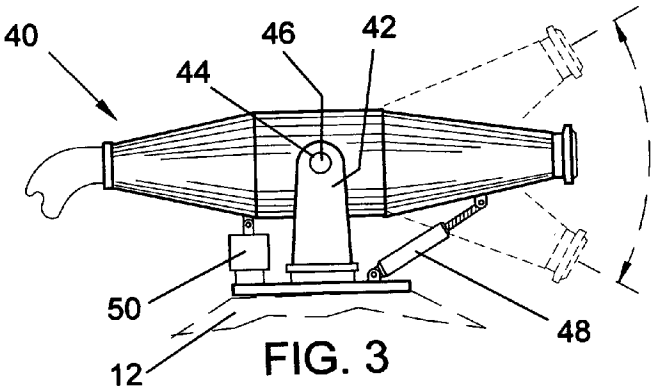
FIG. 3 illustrates a side elevation view of a fire retardant discharge device according to an embodiment of the invention.
Figure 4:
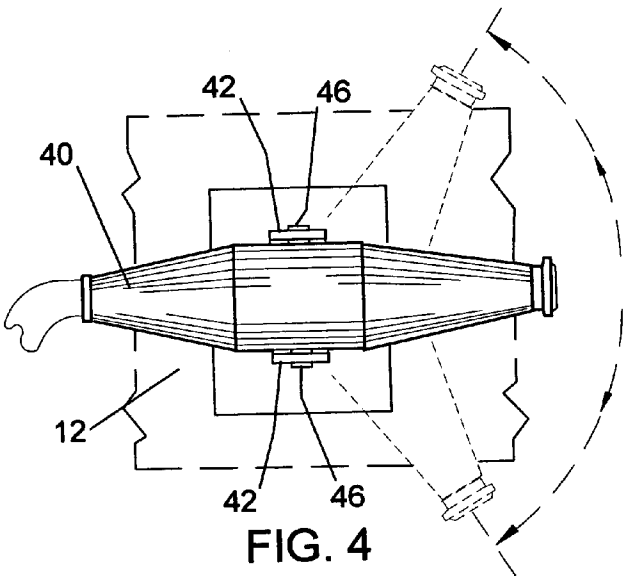
FIG. 4 illustrates a top view of a discharge device according to an embodiment of the invention.
Figure 2:
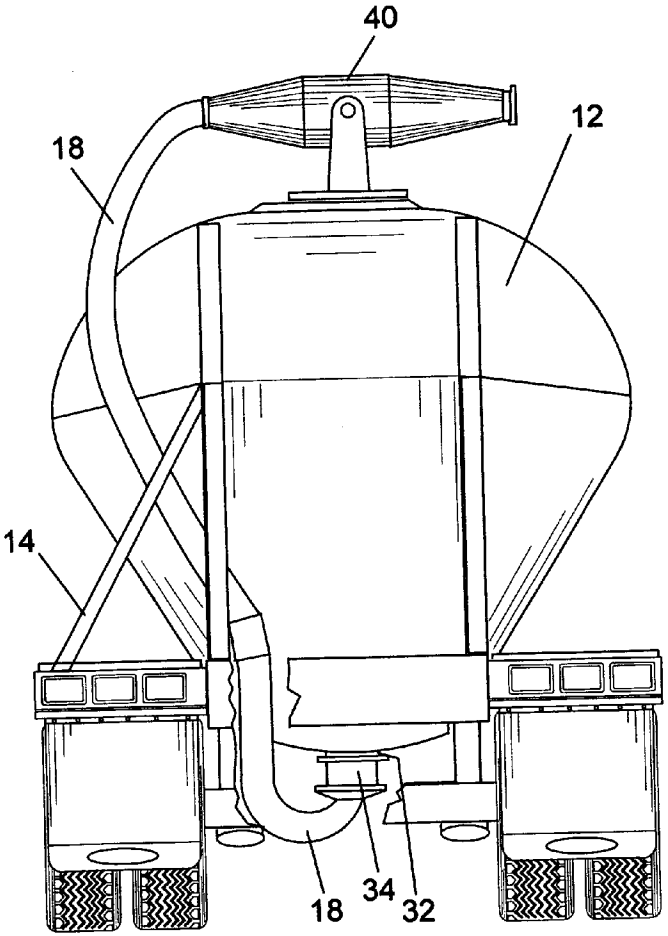
FIG. 2 illustrates a rear elevation view of a discharge apparatus according to an embodiment of the invention.
Figure 5:
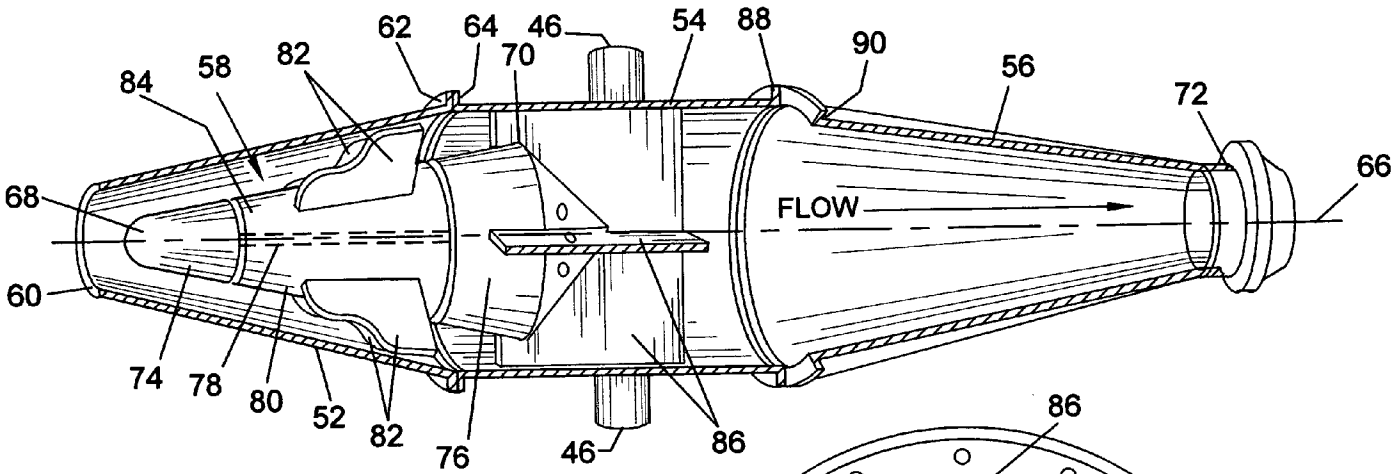
FIG. 5 illustrates a top cross-sectional view of a discharge device according to an embodiment of the invention.
Figure 6:
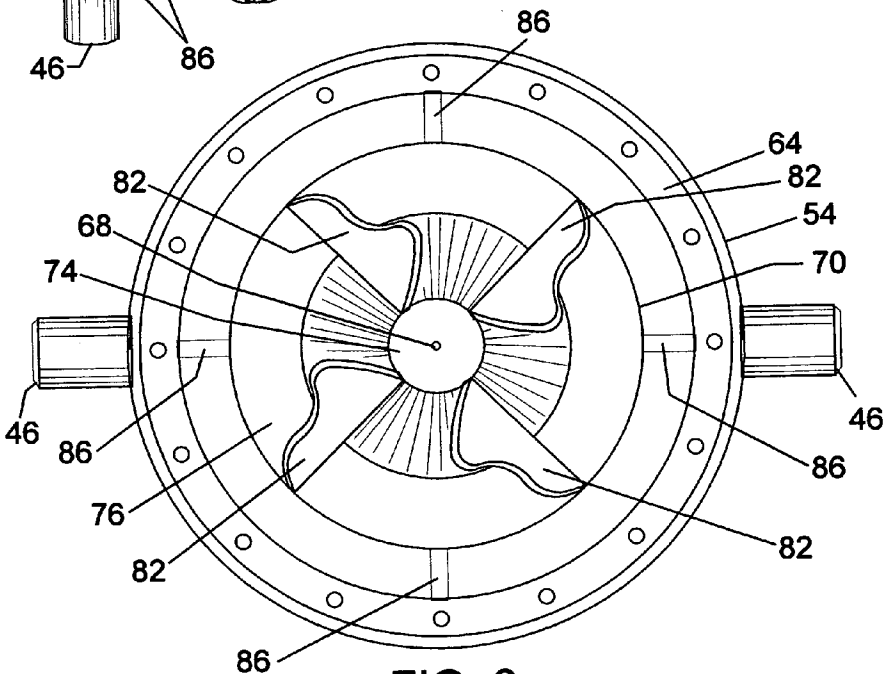
FIG. 6 illustrates an inlet end view of a discharge device with an inlet duct removed according to an embodiment of the invention.

Referring to FIGS. 1 and 2, a fire retardant discharge apparatus 10 may have a container element 12 with a mixer or aerator device that may be assembled as part of a trailer or truck chassis 14. There may be a tractor or cab with engine 16. A discharge device 40 may be connected to the container element 12 by a discharge conduit 18. A gas pressure such as air pressure apparatus 22 may be positioned on the truck tractor 16 and may be connected to the container element 12 by an air pressure conduit 24 that may have a container pressure conduit 26 and an aerator conduit 28. The conduits 24, 26, 28 may each have a one-way valve 30 positioned to inhibit back flow of air and retardant toward the air pressure apparatus 22. The valves 30 may be manual or pressure operated valves.

The container element 12 may have a mixing or aeration element (not shown) interior to the container element 12 to direct pressurized air flow into granular or powder fire retardant material contained in the container. The mixing or aeration may cause the fire retardant material to expand or spread to mix with the pressurized air in the container to form a generally fluid mixture, for example, with use of di-ammonium phosphate. There may be a container output conduit 32 that may have a container output valve 34 that may also reduce the container output conduit 32 flow diameter of approximately 8 inches to the discharge conduit 18 diameter of approximately 4 inches. When it may be desired to discharge fire retardant material, the container output valve 34 may be opened to allow flow from the container element 12 through the discharge conduit 18 to the discharge device 40.

Referring to FIGS. 1 through 4, a discharge device 40 may be attached to the top of the container element 12 on a pedestal mount 42 that may allow rotation and elevation of the discharge device 40. The mount 42 may have mount apertures 44 for rotatable retention of shafts 46 attached to the expansion element of the discharge device 40. A vertical actuator 48 may be used to position the discharge device 40 in elevation, for example, between 30 degrees declination and 30 degrees inclination. The mount 42 may rotate about a vertical axis. A rotational actuator 50 may be positioned to rotate the mount 42 and discharge device 40 approximately 90 degrees right or left relative to the lateral axis of the container element 12. Other rotational angles may be used depending on the structure and clearance for the discharge conduit 18.

Referring to FIGS. 3 through 6, the discharge device 40 may be a generally circular cross section conduit having an inlet duct 52 that is divergent in the direction of air-retardant material flow, an expansion section 54 that is generally constant diameter, and an outlet duct that is convergent in the direction of air-retardant material flow. An inlet 60 may be connected to the outlet end of the discharge conduit 18. The divergent inlet duct 52 may be connected at a downstream end 62 to the inlet end 64 of the expansion section 54. A diffuser 58 may be positioned along the longitudinal axis 66 and in the center of the inlet duct 52 and expansion section 54. The diffuser 58 may be generally conical in shape with the tip 68 of the cone adjacent the inlet 60 and the base 70 of the cone positioned in the upstream portion of the expansion section 54. The diameter of the base 70 may be selected to define a cross-sectional area relative to the expansion section 54 duct wall that is approximately equal to the outlet nozzle 72 cross section area. The base 70 may define a constriction or choke position in the discharge device 40.

The diffuser 58 may have a nose element 74 connected to a base element 76 by a diffuser shaft 78. A diffuser rotor element 80 may be rotatably attached to the diffuser shaft 78. There may be two or more fins or vanes 82 attached to the outer surface 84 of the rotor element 80. The vanes 82 may be inclined relative to the longitudinal axis 66 such that air-retardant flow through the discharge device 40 may impact the vanes 82 at an inclined angle to thereby cause rotation of the rotor element 80. The vanes 82 may act to break or split into smaller pieces any clots or lumps of retardant that may occur, for example, due to the characteristic of a retardant that tends to absorb moisture. The base element 76 may be attached to two mounting plates 86 that may be attached interior to the expansion section 54 generally orthogonal one to the other.

The downstream end 88 of the expansion section 54 may be attached to the inlet end 90 of the outlet duct 56. An example discharge device 40 has been found to perform effectively in discharging a fire retardant based on di-ammonium phosphate or PHOS CHEK. An inlet 60 diameter of 4 inches was connected to a 4 inch discharge conduit 18. An air-retardant material flow at the inlet 60 at 15 psi and 450 mph produced an outlet nozzle 72 flow at approximately 18 psi and 500 to 550 mph. The air-retardant flow in the discharge device 40 may experience a decrease in velocity and an increase in pressure caused by impacting the rotor element 80 as compared to the reduction from a 4 inch inlet diameter to the equivalent of a 3 inch diameter at the base 70 or choke point. Downstream of the base 70 the flow velocity may further decrease due to the diameter of the expansion section 54. The expansion section 54 had a diameter of approximately 10 inches for the example device. The outlet duct 56 may then increase the flow velocity to exit the outlet nozzle 72. The outlet nozzle 72 velocity may cause the fire retardant material to travel airborne for approximately 100 to 200 yards depending on environmental conditions at a rate of 15 tons in approximately 5 to 6 minutes. This discharge rate may cover a 100 acre area such as a canyon, an area adjacent a road for a fire break or the like.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for discharging a fire retardant material comprising:

a container element with a pressurized gas source controllable to pressurize said container element and to flow a gas and a fire retardant material mixture through a discharge conduit;

a discharge device connected at an inlet to an outlet end of said discharge conduit, said discharge device comprising:

an inlet duct attached at a downstream end to an inlet end of an expansion section and said expansion section connected at a downstream end to an inlet end of an outlet duct having an outlet nozzle;

a diffuser disposed in said inlet duct having a divergent cross-sectional circular form in the direction of downstream flow and disposed and attached in an upstream portion of said expansion section having a constant diameter cross-sectional circular form wherein said diffuser has a generally conical form with a tip end adjacent said inlet and a base end in said upstream portion;

said diffuser has a nose element attached to a diffuser shaft that is attached to a base element and a rotor element is rotatably attached on said diffuser shaft intermediate said nose element and said base element; and said rotor element having a plurality of vanes attached to an outer surface of said rotor element wherein said plurality of vanes are inclined relative to a longitudinal axis of said discharge device.

2. The apparatus as in claim 1 wherein said plurality of vanes is four vanes with two pairs of opposed vanes each disposed orthogonally.

3. The apparatus as in claim 1 wherein said diffuser is attached at said base element to two orthogonally disposed mounting plates that are attached to said upstream portion.

4. The apparatus as in claim 1 wherein said discharge device is rotatably attached to a pedestal mount that is rotatably attached to said container element at a top.

5. The apparatus as in claim 4 wherein said discharge device elevation is controlled by a vertical actuator and horizontal position is controlled by a rotational actuator.

6. The apparatus as in claim 1 wherein said container element is attached to a trailer chassis.

7. The apparatus as in claim 1 wherein said container element has an aerator device therein connected to said pressurized gas source.

8. The apparatus as in claim 1 wherein said pressurized gas source connected to a gas pressure conduit having a first one-way valve that is connected to a container pressure conduit having a second one-way valve and an aerator conduit having a third one-way valve.

9. The apparatus as in claim 1 wherein said container element having a container output conduit with a container output valve connected to said discharge conduit.

10. The apparatus as in claim 1 wherein said inlet is a larger cross section area than an area defined by a separation between said base end and said expansion section interior wall wherein said separation is approximately equal to said area of said outlet nozzle.

11. The apparatus as in claim 1 wherein said gas is air.

12. The apparatus as in claim 1 wherein said fire retardant material is di-ammonium phosphate.

* * * * *